US006066687A

United States Patent [19]

Capone et al.

[11] Patent Number: 6,066,687

[45] Date of Patent: May 23, 2000

[54] ACRYLIC FIBER WITH HIGH OPTICAL BRIGHTNESS

[75] Inventors: Gary Joseph Capone; Henry Gook Chin, both of Decatur, Ala.

[73] Assignee: Solutia Inc., St. Louis, Mo.

[21] Appl. No.: 08/264,870

[22] Filed: Jun. 24, 1994

[51] Int. Cl.[7] ..... C08K 5/34; C08K 3/18; C08K 3/22

[52] U.S. Cl. ..... 524/94; 524/431

[58] Field of Search ..... 524/94, 431

[56] References Cited

U.S. PATENT DOCUMENTS

| | | | |
|---|---|---|---|
| 2,607,751 | 8/1952 | Flanagan | 260/30.4 |
| 2,975,022 | 3/1961 | Euler | 18/54 |
| 3,671,653 | 6/1972 | Berry, Jr. | 264/39 |
| 3,676,540 | 7/1972 | Story et al. | 264/177 F |
| 3,737,508 | 6/1973 | Weir | 264/204 |
| 3,932,577 | 1/1976 | Palethorpe et al. | 264/182 |
| 4,307,152 | 12/1981 | Mathes et al. | 428/373 |
| 4,420,507 | 12/1983 | Marco | 427/170 |
| 4,607,071 | 8/1986 | Hahnke et al. | 524/94 |
| 4,999,245 | 3/1991 | Orino et al. | 428/374 |

FOREIGN PATENT DOCUMENTS

| | | |
|---|---|---|
| 2 063 929 | 6/1981 | United Kingdom . |

*Primary Examiner*—Kriellion Sanders
*Attorney, Agent, or Firm*—Arnold, White & Durkee

[57] ABSTRACT

An acrylic fiber exhibiting improved brightness and processability is disclosed. The fiber includes a synergistic combination of a delustrant and an optical brightener and is specifically useful in the manufacture of "terry" knitted athletic socks.

13 Claims, No Drawings

ACRYLIC FIBER WITH HIGH OPTICAL BRIGHTNESS

BACKGROUND OF THE INVENTION

1. Field of the Invention

The present invention is generally directed to acrylic fibers. More specifically, the present invention is directed to acrylic fibers comprising a synergistic combination of at least one delustrant and at least one optical brightener. The fibers are useful especially in athletic sock applications.

2. Description of the Prior Art

In years past, athletic socks were typically manufactured by knitting cotton fibers into a "terry" construction. While cotton was typically the primary fiber in this utility, it had significant disadvantages associated therewith. First, it required significant processing at the textile mill to impart the level of brightness which was desired by consumers. More specifically, cotton was and continues to be typically subjected to chemical bleaching and optical brightening processes at the textile mill when processed to socks.

These processing steps are disadvantageous from a number of aspects. First, they add an undesirable able cost to the final product through the expense of the processing steps per se and the cost of the related chemicals. Further, use of many of the treatment chemicals is subject to rigorous governmental regulations regarding human exposure, transportation, waste disposal and the like. Compliance with these and other internal safety regulations are the source of additional resource allocation and expense to the textile mill which correspond to an increased cost for the textile product.

Other disadvantages of cotton in this utility have further motivated the search for an alternative thereto. For example, cotton exhibits the tendency to retain moisture and typically soils easily and permanently.

Synthetic fibers, such as acrylic fibers, exhibit desirable soil resistance and moisture transport properties but have heretofore been thought to be inferior to cotton's initial appearance, proccessability and brightness.

A need therefore exists for a synthetic fiber which exhibits the desirable optical characteristics of cotton while avoiding the difficult and costly processing steps and other disadvantages inherent in its use.

3. Brief Summary of the Invention

The present invention satisfies this need and achieves other results as set forth in more detail below by providing an acrylic fiber comprising a synergistic combination of from about 500 to about 1500 parts per million (ppm), based on the total weight of the fiber, of an optical brightener and from about 1% to about 2%, based on the total weight of the fiber, of a delustrant. The fiber of the present invention exhibits a tristimulus brightness level, Y, of at least 79 when measured in accordance with the test set forth in detail below.

The fiber of the present invention is especially useful in the manufacture of athletic socks which are based primarily on a synthetic fiber.

4. Detailed Description of the Invention

The fibers of the present invention are formed from a fiber-forming acrylonitrile polymer. The term "acrylonitrile polymer", as utilized herein, is defined to include all polymers comprising at least about 85% by weight acrylonitrile groups,

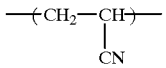

as well as copolymers, terpolymers and the like thereof. Useful comonomers which may be polymerized with acrylonitrile to form useful copolymers, terpolymers and the like include, for example, methyl acrylate; ethyl acrylate; butyl acrylate; methoxymethylacrylate; beta-chloroethyl acrylate and the corresponding esters of methacrylic and chloracrylic acids; vinyl chloride; vinyl fluoride; vinyl bromide; vinylidene chloride; vinylidene bromide; allyl chloride; 1-chloro-l-bromo-ethylene; methacrylonitrile; methyl vinyl ketone; vinyl formate; vinyl acetate; vinyl propionate; vinyl stearate; vinyl benzoate; N-vinyl phthalimide; N-vinyl succinimide; methylene malonic esters; itaconic esters; diethyl citraconate; diethyl mesaconate; styrene; dibromostyrene; vinyl naphthalene; 2-methyl-1-vinyl imidazole; 4-methyl-i-vinyl imidazole; 5-methyl-1-vinyl imidazole; acrylic acid; methacrylic acid; alpha-chloroacrylic acid; itaconic acid; vinyl sulfonic acid; styrene sulfonic acid; methallyl sulfonic acid; p-methoxyallyl benzene sulfonic acid; acrylamidomethyl-propane sulfonic acid; ethylene-alphabeta-dicarboxylic acids and their salts; acrylamide; methacrylamide; isopropylamide; allyl alcohol; 2-vinylpyridine; 4-vinylpyridine, 2-methyl-5-vinylpyridine; vinylpyrrolidone; hydroxyethyl methacrylate; vinylpiperidone; 1,2-hydroxypropyl methancrylate; and the like. A preferred acrylonitrile polymer includes about 90 to 95 percent by weight acrylonitrile and about 5 to about 10 percent by weight vinyl acetate.

The term "fiber", as utilized herein, is defined to include continuous filaments as well as staple fibers formed therefrom.

The fiber of the present invention is an acrylonitrile fiber comprising a synergistic combination of at least one optical brightener and at least one delustrant. Preferably, the optical brightener and the delustrant are interdispersed in the acrylonitrile polymer. Preferred optical brighteners include, without limitation, benzimidazoles or derivatives thereof, such as that available commercially from Ciba-Geigy under the name UVITEX, or pyrazolines or derivatives thereof, such as that commercially available from Hoechst under the name HOSTALUX NR. Other optical brighteners are well known in the art. Useful delustrants are well known in the art and include, without limitation, titanium dioxide, borate compounds and zinc oxide. A preferred delustrant is particulate titanium dioxide, with a particulate titanium dioxide having a mean particle diameter of about 0.25 micron being particularly preferred.

The optical brightener and delustrant are present, in combination, in an amount sufficient to impart to the fiber a tristimulus brightness value of at least 79 when measured in accordance with the following test.

The sample fiber to be tested, initially in commercially conventional tow form, is cut to a length of about 1.0 to 1.5 inches, carded and mounted on a sample holder. A spectrophotometer, such as that commercially available from BYK-Gardner, is then set to the following specifications for analysis of the fiber sample:

1. 2-Degree Observer
2. Large Area Specular Excluded
3. Illuminant C
4. Calibration to Japanese Opal Standard with the following tristimulus values:

X=90.71
Y=92.57
Z=109.57

From these values, chromaticity values are calculated according to the following equations:

$$x=X/(X+Y+Z)$$

$$y=Y/(x+Y+z)$$

The fibers of the present invention exhibit a tristimulus brightness value (Y) of at least about 79, more preferably at least about 82. Most preferably, the fibers of the present invention exhibit a tristimulus X value of at least about 80; a tristimulus Y value of at least about 82; a tristimulus Z value of at least about 96; and chromaticity values (x and y) of less than about 0.3090 and 0.3150, respectively.

Although the specific amount of the individual components may vary widely depending on the specific optical brightener and delustrant used, the amount of optical brightener is preferably about 800 to about 1700 parts per million (ppm) based on the total weight of the fiber while the amount of delustrant is preferably about 1% to about 2% based on the total weight of the fiber. A particularly preferred fiber includes about 2% by weight based on the total weight of the fiber titanium dioxide having a mean particle diameter of about 0.25 microns and about 1300 to about 1700 ppm based on the total weight of the fiber of an optical brightener selected from the group consisting of pyrolazines or derivatives thereof or benzimidazoles or derivatives thereof.

The fibers of the present invention may be manufactured by any of the well-known, conventional processes for manufacturing acrylonitrile-based fibers by adding the delustrant and the optical brightener to the spinning solution, or dope, preferably with conventional tints and stabilizers, prior to spinning. Suitable spinning processes include "wet spinning" processes, wherein the polymer is placed in solution and extruded through at least one spinneret into a solvent-containing coagulating bath; and "dry spinning" processes, wherein a polymer solution is extruded through at least one spinneret into an evaporative atmosphere. These processes are exemplified in U.S. Pat. No. 2,607,751, the disclosure of which is incorporated herein by reference. Wet spinning is further exemplified in U.S. Pat. Nos. 3,676,540 and 3,932,577, while dry spinning is further exemplified in U.S. Pat. Nos. 2,975,022 and 3,737,508, all of the disclosures of which are incorporated herein by reference. Depending on the specific materials which are added to the dope prior to spinning, it may be desirable to lower the spin press temperature to avoid thermal degradation of these materials.

The wet-spun or dry-spun fiber, after removal of substantially all solvent therefrom, is then drawn to impart fiber orientation and strength. A textile finish and mechanical crimp are applied to the fiber for normal conversion to a textile yarn. The fiber is relaxed using conventional processing techniques and conditions to arrive at desired physical properties, such as tenacity and elongation. The fiber, in either tow or staple form, is converted into yarns and fabrics using standard textile equipment.

The fiber of the present invention may be characterized by any of the many cross sectional configurations known in the art, including, without limitation, "bean-shaped" as exemplified in U.S. Pat. No. 4,999,245; substantially round; "dumbbell" or "dogbone" as exemplified in U.S. Pat. No. 2,975,022: elliptical; triangular; and trilobal. A particularly preferred cross section is substantially round, as this cross section is easily processable and imparts improved appearance to socks manufactured with fibers of the present invention.

The fibers of the present invention may have any denier conventionally used in textile manufacture. Preferably, the fibers have a denier of from about 0.8 to about 8.0, most preferably from about 1.9 to about 3.0.

Appearance, uniformity and proccessability of the fibers of the present invention when utilized in sock applications are further improved by selecting a preferred fiber crimp level of about eight to about thirteen crimps per inch (about 3.15 to about 5.12 crimps per centimeter) and a crimp variability of about 20%. "Crimp level", as utilized herein, is defined as the number of crimps or bends along the length of the fiber per unit length while "crimp variability", as utilized herein, is defined as the standard deviation of the crimp level along a sample of fiber divided by the average crimp level along that sample.

The crimp level is preferably measured using an image analyzer, for example the LeMont OASYS (Optical Analysis System) Image Analyzer available commercially from LeMont Scientific State College, P.A. In this test procedure, a test fiber sample is identified by (1) randomly selecting four bundles of fiber, approximately one-fourth inch in width by three inches in length, from a three-foot length of tow and then (2) randomly selecting three individual fibers from each bundle. The individual fibers are then separately mounted on a glass slide under an amount of tension sufficient to hold the fibers in place but insufficient to pull out or remove any crimp present therein and another slide is placed atop the mounted fibers. After calibration and preliminary setup of the image analyzer, the crimp level test sample is measured therewith and the crimp variability is calculated from the crimp level data.

The following examples, while not intended to limit the scope of the present invention, provide a detailed illustration of the present invention.

EXAMPLES

A copolymer of about 92.5 percent by weight acrylonitrile and about 7.5w by weight vinyl acetate was prepared by conventional methods. Individual spinning solutions (dopes) of approximately 25 percent by weight polymer concentration were then formed by placing the copolymer in solution using a conventional DMAC solvent. A delustrant (titanium dioxide) was then added to each dope in varying concentrations as set forth in Table 1 below. The dopes were then spun into fibers (with extraction of solvent therefrom) and the resulting fibers, as a tow, were drawn, coated with finish, crimped and relaxed by conventional methods. An optical brightener was added to each sample in varying concentrations as set forth in Table 1 during the spinning process when the fiber is still in the gel state (uncollapsed fiber).

The fibers were then analyzed for optical characteristics (X,Y,Z,x,y) utilizing the procedures set forth above. The results of the analysis are set forth below in Table 1.

TABLE 1

FIBER OPTICAL CHARCTERISTICS

| Sample No. | Delustrant, % by weight | Optical Brightener, ppm | X | Y | Z | x | y |
|---|---|---|---|---|---|---|---|
| *1 | 0.25 | 1300 | 74.86 | 76.98 | 89.19 | 0.3106 | 0.3194 |
| *2 | 0.25 | 1500 | 73.91 | 75.96 | 88.16 | 0.3105 | 0.3191 |
| *3 | 0.25 | 1700 | 74.60 | 76.71 | 89.33 | 0.3100 | 0.3188 |
| 4 | 1.00 | 1300 | 77.52 | 79.61 | 91.19 | 0.3122 | 0.3206 |
| 5 | 1.00 | 1500 | 77.55 | 79.59 | 91.48 | 0.3119 | 0.3201 |

TABLE 1-continued

FIBER OPTICAL CHARCTERISTICS

| Sample No. | Delustrant, % by weight | Optical Brightener, ppm | X | Y | Z | x | y |
|---|---|---|---|---|---|---|---|
| 6 | 1.00 | 1700 | 77.08 | 79.12 | 91.04 | 0.3118 | 0.3200 |
| 7 | 2.00 | 1300 | 79.02 | 81.23 | 93.41 | 0.3115 | 0.3202 |
| 8 | 2.00 | 1500 | 78.58 | 80.59 | 91.90 | 0.3130 | 0.3210 |
| 9 | 2.00 | 1700 | 78.33 | 80.37 | 91.59 | 0.3130 | 0.3211 |
| +10 | 2.00 | 960 | 80.62 | 82.65 | 96.56 | 0.3103 | 0.3181 |
| +11 | 2.00 | 1300 | 80.49 | 82.61 | 97.11 | 0.3093 | 0.3175 |

*control
+samples from commercial-scale production runs

As demonstrated by the above data, the fibers of the present invention exhibit desirable optical characteristics, especially brightness, which is evidenced by the tristimulus Y value.

We claim:

1. A fiber formed from an acrylonitrile polymer, said fiber comprising a delustrant and an optical brightener, wherein said fiber is characterized by a brightness value of at least about 79.

2. The fiber of claim 1 wherein the delustrant is particulate titanium dioxide having a mean particle diameter of about 0.25 microns.

3. The fiber of claim 2 wherein the optical brightener is selected from the group consisting of benzimidazoles and derivatives thereof and pyrazolines and derivatives thereof.

4. The fiber of claim 3 wherein said brightness value is at least about 82.

5. The fiber of claim 4 wherein said fiber is further characterized by a substantially round cross section.

6. The fiber of claim 5 wherein the crimp level of said fiber is from about eight to about thirteen crimps per inch.

7. The fiber of claim 6 having a denier of from about 1.9 to about 3.0.

8. A fiber formed from an acrylonitrile polymer, said fiber comprising a delustrant in an amount of from about 1% to about 2% based on the total weight of the fiber and an optical brightener in an amount of from about 500 to about 1500 ppm based on the total weight of the fiber.

9. The fiber of claim 8 wherein the delustrant is particulate titanium dioxide having a mean particle diameter of about 0.25 microns.

10. The fiber of claim 9 wherein the optical brightener is selected from the group consisting of benzimidazoles and derivatives thereof and pyrazolines and derivatives thereof.

11. The fiber of claim 10 wherein said fiber is characterized by a substantially round cross section.

12. The fiber of claim 11 wherein the crimp level of said fiber is from about eight to about thirteen crimps per inch.

13. The fiber of claim 12 having a denier of from about 1.9 to about 3.0.

* * * * *